US006088843A

United States Patent [19]

Francisco

[11] Patent Number: 6,088,843

[45] Date of Patent: Jul. 18, 2000

[54] DRAIN STRAINER WITH SIEVE RECEPTACLE AND BRISTLE EXTENSION

[76] Inventor: Richard Francisco, 4040 Seven Hills Rd., Castro Valley, Calif. 94546

[21] Appl. No.: 09/290,036

[22] Filed: Apr. 8, 1999

[51] Int. Cl.[7] ..... E03C 1/26

[52] U.S. Cl. ..... 4/289; 4/290; 4/291

[58] Field of Search ..... 4/286–295, 694, 4/605, 613

[56] References Cited

U.S. PATENT DOCUMENTS

| | | | |
|---|---|---|---|
| 214,983 | 5/1879 | Atwater | 4/287 |
| 1,333,433 | 3/1920 | Maisano | 4/289 |
| 1,342,046 | 6/1920 | Heino . | |
| 1,589,544 | 6/1926 | Natow et al. . | |
| 1,645,986 | 10/1927 | Crocker | 4/295 |
| 1,935,128 | 5/1933 | Pullman . | |
| 2,024,475 | 12/1935 | Rossman | 4/287 |
| 2,233,234 | 2/1941 | Wilson | 4/291 |
| 2,505,305 | 4/1950 | Schaefer | 4/289 |
| 2,690,569 | 10/1954 | Kozerski | 4/292 |
| 4,164,796 | 8/1979 | Sakow . | |
| 4,207,631 | 6/1980 | Baggey | 4/286 |
| 4,825,477 | 5/1989 | Aranda . | |
| 4,999,858 | 3/1991 | Wu | 4/290 |
| 5,377,362 | 1/1995 | Jackson . | |

*Primary Examiner*—Charles R. Eloshway
*Attorney, Agent, or Firm*—Richard Esty Peterson

[57] ABSTRACT

A drain strainer that is installed in the vertical drain pipe of a bathing water drain for a shower or tub, the drain strainer having an upper sieve receptacle in the form of a substantially cylindrical basket with openings for passage of water and smaller debris, and a lower bristle extension in the form of a depending stem with projecting bristles that ensnare hair shed from the bather, the drain strainer including a support structure to suspend the sieve receptacle and bristle extension within the drain pipe.

7 Claims, 2 Drawing Sheets

FIG. 3
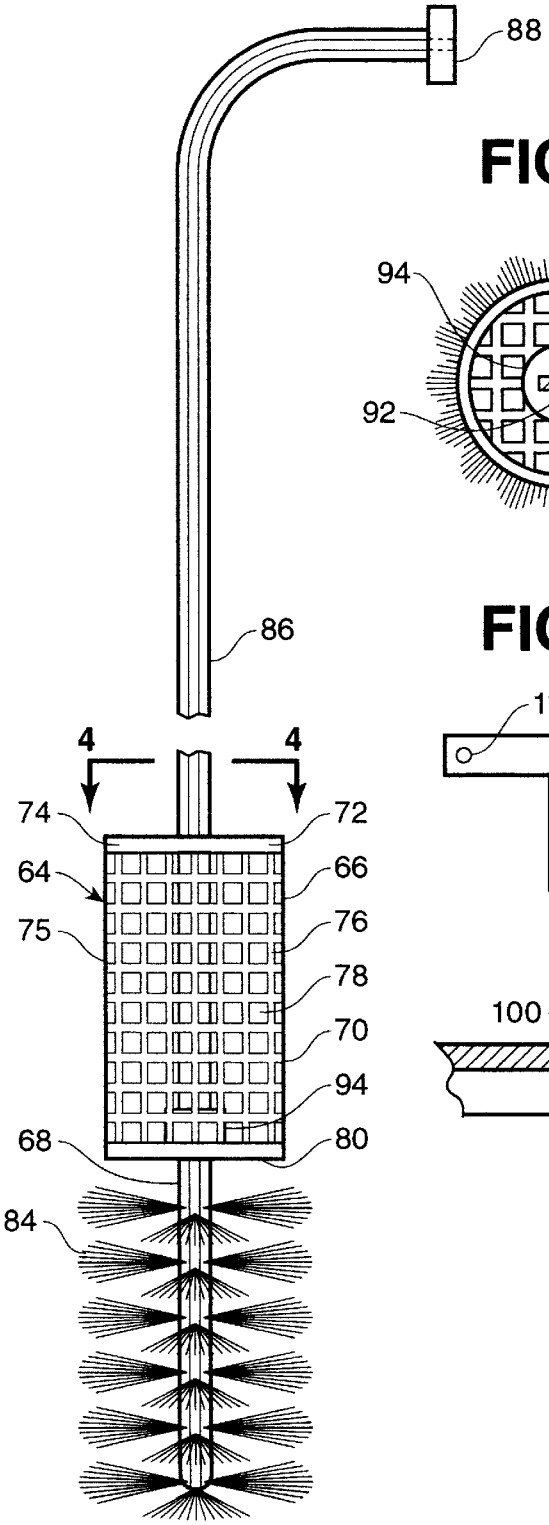
FIG. 4
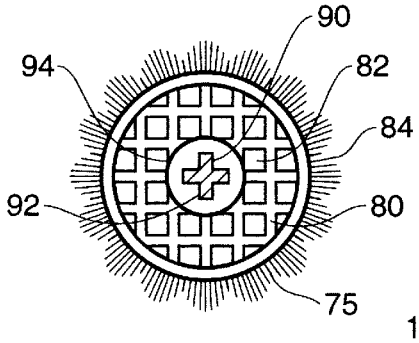
FIG. 5
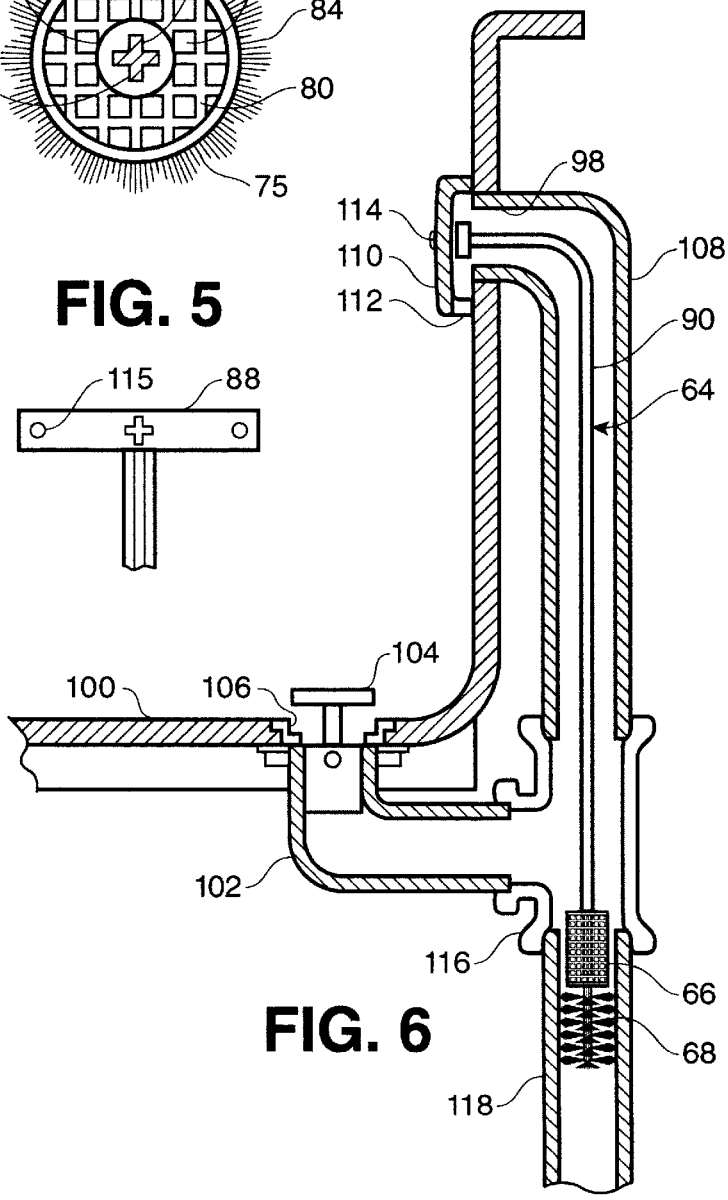
FIG. 6

DRAIN STRAINER WITH SIEVE RECEPTACLE AND BRISTLE EXTENSION

BACKGROUND OF THE INVENTION

This invention relates to a drain strainer and in particular to a removable strainer for use in a shower drain or a tub drain. The drain strainer is of simple construction and is designed to be fabricated from inexpensive materials permitting the strainer to be either cleaned and reused, or disposed after a period of use.

The drain strainer of this invention has an upper sieve receptacle connected to a lower bristle extension. The upper sieve receptacle is in the form of a basket and will trap and retain any small objects such as toothpaste caps, rings, shampoo lids, contact lenses, or any other small items that inadvertently pass through the grate of a typical drain cover in a shower or the open drain of a tub. The lower bristle extension is preferably similar in construction to a bottle brush. The extension has a semirigid, non-metallic stem and a plurality of radical filaments. The lower bristle extension will ensnare and collect hair that passes through the upper basket.

The drain strainer of this invention is designed to be installed inside the vertical drain pipe of a tub or shower above the trap, and, unlike many prior art strainer receptacles is designed to be hidden from view. When the drainage noticeably slows, the shower floor drain cover or bathtub overflow plate is removed and the drain strainer withdrawn. As noted, the drain strainer can be cleaned and reused or preferably discarded and replaced with a new strainer. The periodic cleaning or replacement of the drain strainer prevents costly plumbing expenses in freeing a backed-up drain. Typically, backup of a bathing water drain is caused by buildup of hair and debris at a joint in the drain pipe. This build up of hair traps other debris to form a barrier. Use of a drain strainer collects hair in a vertical segment of pipe, which maximizes the flushing action to shed smaller debris and prolong the usefulness of the strainer until removal is required.

SUMMARY OF THE INVENTION

The drain strainer of this invention is designed to prevent backup of a drain pipe, particularly the drain pipe of a shower or bathtub that receives hair shed by a bather. Additionally, small articles that pass through the grate of a shower cover or under a tub plug can be trapped in a sieve receptacle. The preferred construction comprises an upper sieve receptacle in the form of a basket that is connected to a depending bristle extension with radial filaments to ensnare hair and prevent to the hair from passing to the drain system. The drain strainer is preferably fabricated from inexpensive, non-corrosive materials such as a plastic basket and a plastic stem with projecting polymer filaments for the bristle extension. Although a variety of different materials may be utilized, the basic assembly is the same with an upper basket and a lower bristle extension.

Minor differences in construction are required for the use of the drain strainer in a shower drain and in a tub drain. In the shower drain, the drain strainer includes a top flange and a cross bar, the former element to seat the drain strainer and the latter element to allow convenient removal with finger and thumb when the shower drain cover is removed. In the tub drain, the drain strainer includes an elongated support probe allowing the drain strainer to be installed through the overflow spout and suspended in the vertical drain pipe below the tub drain connection. The elongated probe has a bracket that is fastened to the tub by the screws that hold the overflow cover plate. Other minor differences in construction may be required to adapt the drain strainer to a particular shower drain or tub drain.

BRIEF DESCRIPTION OF THE DRAWINGS

FIG. 3 is a side elevational view of a second embodiment of the drain strainer of this invention.

FIG. 4 is a cross sectional view taken on the lines 4—4 in FIG. 3.

FIG. 5 is a partial view of the support probe and end bracket for the drain strainer of FIG. 3.

FIG. 6 is a partial cross-sectional view of a typical tub with the drain strainer installed in the drain pipe.

DETAILED DESCRIPTION OF THE PREFERRED EMBODIMENTS

Figure 1:
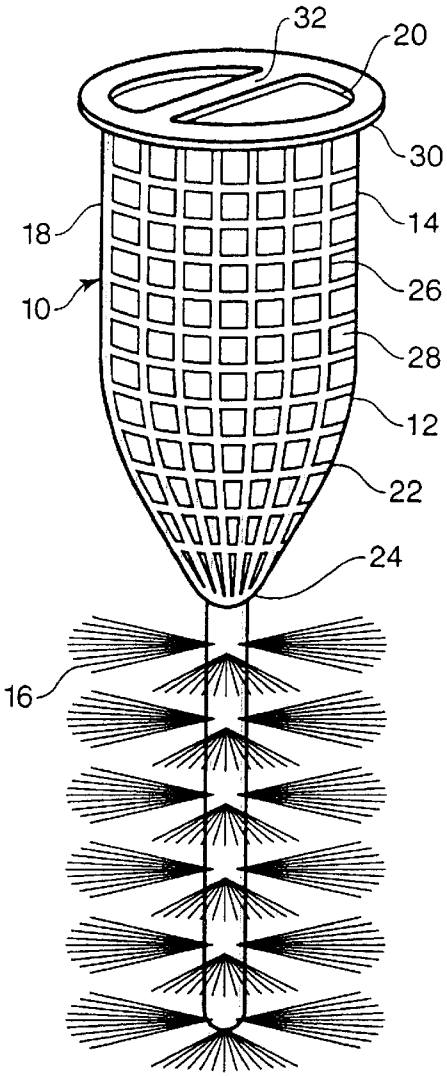
FIG. 1 is a perspective view of a first embodiment of the drain strainer of this invention.

Referring to FIG. 1 a drain strainer, designated generally by the reference numeral 10, is shown in a first embodiment 12. The drain strainer 10 has an upper sieve receptacle 14 connected to a lower bristle extension 16. The upper sieve receptacle 14 forms a basket with a cylindrical portion 18 with a top rim 20, and a tapering conical portion 22 with a truncated end 24 having a bore (not visible) for fixed attachment of the lower bristle extension 16 at the center of the bottom of the sieve receptacle as shown in FIG. 1.

The sieve receptacle 14 is preferably fabricated of plastic with horizontal and vertical ribs 26 forming a grid-like structure with openings 28. The openings 28 are sufficiently large to allow free passage of smaller debris, while trapping any articles such as tooth paste caps, rings, contact lenses or other items that might accidently pass to the drain. Openings ⅛ inch to ¼ inch provide relatively unobstructed flow, while capturing items inadvertently lost in the drain. The top rim 20 has a flange 30 used to seat the embodiment 12 of the drain strainer 10 designed for a shower drain. The flange 30 includes a cross bar 32 for convenient finger removal when installed.

Figure 2:
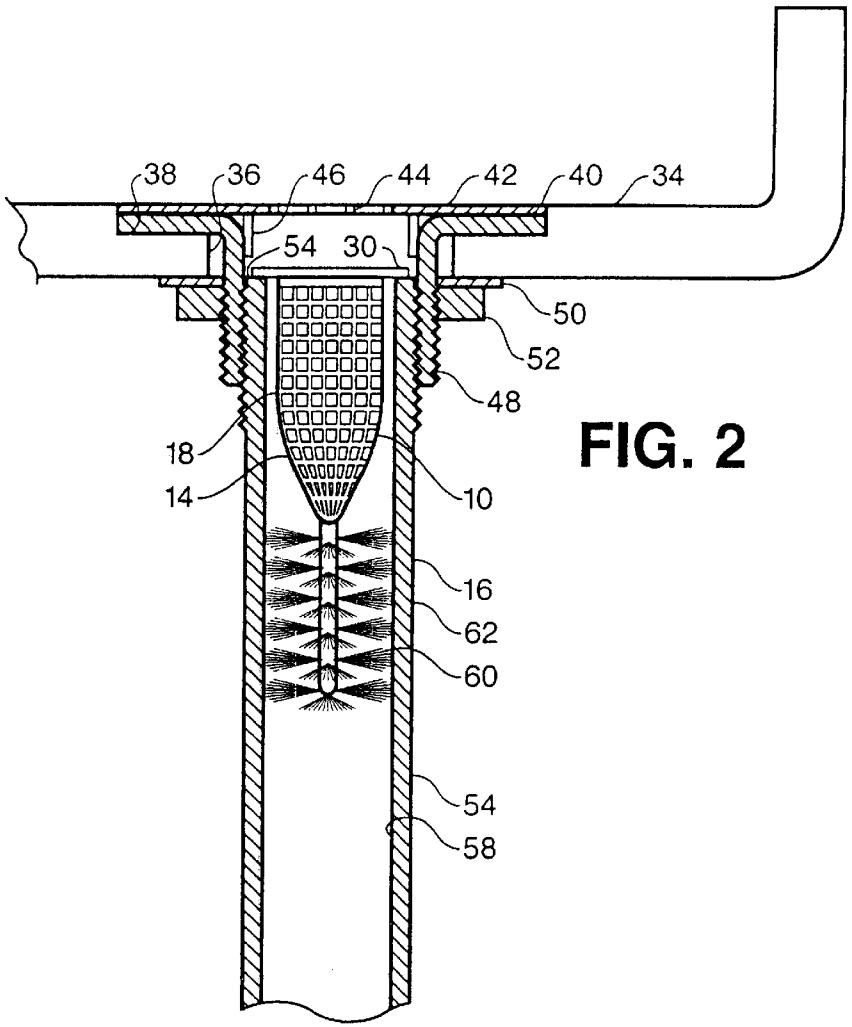
FIG. 2 is a side view, partially in cross section of the drain strainer of FIG. 1 installed in a shower drain.

Referring to FIG. 2, a cross sectional view of the drain section of a shower is shown with a shower stall floor 34. The shower stall floor 34 has a drain hole 36 with a concentric recess 38 for flush mounting of a waste strainer assembly 40. The waste strainer assembly 40 includes a flared flange piece 42 and grate cover 44 that connects to the flange piece 42 by clips 46. The flange piece 42 has an internally and externally threaded collar 48 with a washer 50 and lock nut 52 for securing the strainer assembly 40 to the shower floor 34. A threaded tail pipe 54 connects to the flange piece 42 by the internal threads of the collar. The perpendicularly depending tail pipe 54 connects to the trap and remaining drainage plumbing (not shown) in a conventional manner. The top end 56 of the vertical drain pipe 54 provides a seat for the top flange 30 of the drain strainer 10. As shown, the diameter of the cylindrical portion 18 of the sieve receptacle 14 is smaller than the diameter of the inside wall 58 of the tail pipe 54. This allows water to freely flow through the cylindrical portion 18 of the sieve receptacle 14.

The bristle extension 16 has projecting filaments 60 that radially project from a straight central stem 62 in which they are embedded in the manner of a plastic brush. Preferably, the filaments have a length that reaches the wall 58 to maximize the ability to ensnare hair in the waste water. Since the drain strainer is situated in a vertical section of the drain system, the collected material receives a vigorous flushing action to pass most smaller particles of debris allowing a substantial amount of hair to be collected before water drainage slows. The drain strainer can be removed and cleaned either periodically as a general maintenance task or when a slowing of the water drainage is detected.

In adapting the drain strainer 10 for use in a tub drain, a modified embodiment 64, as shown in FIG. 3 has been devised. The modified embodiment 64 of FIG. 3 includes a sieve receptacle 66 with a connected bristle extension 68. The sieve receptacle 66 has a basket 70 with an open top 72 with a rim 74 without a flange. The basket 70 has a cylindrical portion 75 with a matrix of ribs 76 forming openings 78 and a bottom 80 with similar openings 82 as shown in FIG. 4.

The bristle extension 68 has a plurality of embedded, radially projecting filaments 84, which project beyond the outer circumference of the cylindrical basket portion 75 as shown in FIG. 4. The cylindrical basket portion 75 has a diameter approximately ¼ inch less than the diameter of the drain pipe to facilitate installation and to allow free flow of water through the cylindrical portion 75 of the basket when installed. The bristles preferably contact the inner walls of the vertical drain pipe as shown in FIG. 6 and assist in centrally positioning the drain strainer 10.

In the embodiment 64 for use in the tub drain, the drain strainer has an elongated support probe 86 with an end bracket 88. The elongated support probe 86 is integral with the bristle extension 68 and is formed by a flexible plastic rod 90 with a cross section in the form of a cross 92 as shown in FIG. 4. The rod 90 is bonded to a boss or hub 94 at the center of the basket bottom 80 to maintain the sieve receptacle 66 in position on the rod 90.

The elongated support probe 86 has a bend 96 at the bracket end to position the bracket 88 across the overflow opening 98 of a tub 100 as shown in FIG. 6. Referring to FIG. 6, the tub 100 has a drain 102 with a pop-up plug 104 at the drain opening 106 for selectively passing or blocking water flow from the tub. The tub 100 also has an overflow spout 108 with a convex cover plate 110 covering the overflow opening 98. The cover plate 110 has an overflow passage 112 at the bottom of the plate 110 to pass rising water in the tub to the overflow spout 108. The cover plate 110 has two screws 114 (one shown) holding the cover plate to the tub. The two screws 114 are used to hold the support probe bracket 88 through holes 115 designed to align with the cover plate screws. In this manner the sieve receptacle 66 and bristle extension 68 of the drain strainer 10 can be installed through the opening 98 of the overflow spout 108 using the elongated, flexible support probe 86. The overflow spout 108 and tub drain 102 interconnect at a tee 116. The length of the support probe 86 is designed to position the drain strainer 10 in the top of the vertical drain pipe 118 above the trap (not shown), so that the sieve receptacle 66 receives water released through the tub drain 102. The bristle extension 68 projects down into the vertical drain pipe and assists in centering, the sieve receptacle 66, ensnaring any hair that passes through or around the receptacle.

When it is desired that the drain strainer be cleaned or replaced, the cover plate 110 is removed and the drain strainer withdrawn by the end bracket and support probe. The drain strainer 64 with the elongated support probe can also be used in older tubs with lever operated linkage in the overflow spout for control of the tub plug. In most cases the support probe does not interfere with the linkage or operation of the plug.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A drain strainer for installation into a bathing water drain having a vertical drain pipe, the drain strainer comprising:

a sieve receptacle having a substantially cylindrical basket having openings for passage of water and having an elongated support member;

a bristle extension with a stem having a plurality of projecting bristles, the bristle extension being connected to the sieve receptacle with the sieve receptacle and connected bristle extension installable in the vertical drain pipe with the bristle extension depending from the sieve receptacle; and, means for supporting the sieve receptacle and bristle extension in the vertical drain pipe when the sieve receptacle and connected bristle extension are installed in the vertical drain pipe, wherein in use as a tub drain strainer with the vertical drain pipe connected to an overflow spout on the tub, the support member is connected to the overflow spout and comprises the means for supporting the sieve receptacle and bristle extension in the vertical drain pipe.

2. The drain strainer of claim 1 wherein the elongated support member has an end bracket and the overflow spout has an opening and has a cover plate with fasteners mountable over the opening, the end bracket being connectable to the fasteners of the cover plate.

3. The drain strainer of claim 1 wherein the elongated support member is connected to the bristle extension.

4. The drain strainer of claim 3 wherein the sieve receptacle has an open top and a bottom with a center hub, the elongated support member extending through the open top and connecting with the bristle extension at the center hub.

5. The drain strainer of claim 4 wherein extension has a stem with embedded filaments projecting from the stem.

6. The drain strainer of claim 5 wherein the elongated support member and the stem are of one-piece construction.

7. The drain strainer of claim 2 wherein the elongated support member has a bend proximate the end bracket.

* * * * *